US009903538B2

(12) United States Patent
Takeda et al.

(10) Patent No.: US 9,903,538 B2
(45) Date of Patent: Feb. 27, 2018

(54) CONNECTOR FOR LED MODULE SUBSTRATE

(71) Applicant: SMK Corporation, Tokyo (JP)

(72) Inventors: Toshimitsu Takeda, Toyama (JP); Katsuhiro Kinoshita, Toyama (JP)

(73) Assignee: SMK Corporation, Tokyo (JP)

( * ) Notice: Subject to any disclaimer, the term of this patent is extended or adjusted under 35 U.S.C. 154(b) by 110 days.

(21) Appl. No.: 15/073,643

(22) Filed: Mar. 18, 2016

(65) Prior Publication Data

US 2017/0102115 A1 Apr. 13, 2017

(30) Foreign Application Priority Data

Oct. 7, 2015 (JP) ..... 2015-022083
Oct. 27, 2015 (JP) ..... 2015-211013

(51) Int. Cl.
*F21S 13/02* (2006.01)
*F21K 99/00* (2016.01)
*F21Y 101/02* (2006.01)

(52) U.S. Cl.
CPC ..... *F21K 9/30* (2013.01); *F21Y 2101/02* (2013.01)

(58) Field of Classification Search
CPC ..... F21V 21/30; F21K 9/235; F21K 9/30
See application file for complete search history.

(56) References Cited

U.S. PATENT DOCUMENTS 5,378,169 A 1/1995 Volz et al.
2006/0044840 A1* 3/2006 Watanabe ..... F21S 48/1109 362/647
2011/0103081 A1* 5/2011 Thullier ..... F21S 48/1109 362/396
2014/0179139 A1 6/2014 Tanaka et al.
2015/0260362 A1* 9/2015 Koga ..... F21V 19/045 362/362
2015/0311640 A1* 10/2015 Kurachi ..... H01R 12/775 439/607.31

FOREIGN PATENT DOCUMENTS

JP 4185758 B2 9/2008
JP 2015-118900 A 6/2015

OTHER PUBLICATIONS

Office Action issued for counterpart Japanese Application 2015-211013, issued by the Japan Patent Office on Sep. 19, 2017.

* cited by examiner

*Primary Examiner* — Evan Dzierzynski

(57) ABSTRACT

A connector capable of easily holding, and establishing electrical connection of, an LED module substrate and achieving highly-reliable electrical connection is provided. The connector for holding, and establishing electrical connection of, an LED module substrate includes: a lower cover member for placing the LED module substrate thereon; and an upper cover member pivotally attached to an end of the lower cover member. The upper cover member includes a feeding connection terminal configured to be elastically in contact with a feeding pad provided in the LED module substrate. When the upper cover member is closed relative to the lower cover member with a pivotal movement, the connection terminal elastically connects with a surface of the feeding pad while sliding thereon.

2 Claims, 9 Drawing Sheets

CONNECTOR FOR LED MODULE SUBSTRATE

CROSS REFERENCE TO RELATED APPLICATION

The contents of the following Japanese applications are incorporated herein by reference, Japanese Design Application No. 2015-022083 filed on Oct. 7, 2015, and Japanese Patent Application No. 2015-211013 filed on Oct. 27, 2015.

FIELD

The present invention relates to a connector used for the electrical connection of a chip-on type LED module substrate.

BACKGROUND

Chip-on-board (COB) LED module substrates in which LED elements are mounted on substrates have been employed in the field of lighting, etc.

In this case, connectors for providing power to the LED module substrates have been used.

For example, Patent Literature 1 discloses a cover assembly for interposing an LED array (LED module substrate) by causing deflection terminals provided in a cover to be in contact with an anode and a cathode of the LED array and then fixing the cover to a support.

However, such a configuration in which the LED module substrate is interposed in the vertical direction between the cover and the support, for example, and fixed with screws has a problem in that a contact pressure of the deflection terminals (connection terminals) in which feeding terminals are elastically in contact with feeding pads of the LED module substrate varies depending on the tightening force of the screws.

Alternatively, an upper cover member and a lower cover member may be individually prepared beforehand and an LED module substrate may be interposed between the upper and lower cover members. In such a configuration, the upper cover member and the lower cover member need to be handled separately and therefore need to be packed separately during the transportation thereof.

Furthermore, there is a risk of a connection terminal (contact) provided in the upper cover member to be touched unintentionally and thereby deformed.

CITATION LIST

Patent Literature

Patent Literature 1: Japanese Patent Application Laid-Open No. 2015-118900

SUMMARY

Technical Problem

It is an object of the present invention to provide a connector capable of easily holding, and establishing electrical connection of, an LED module substrate and achieving highly-reliable electrical connection.

Solution to Problem

In accordance with one aspect of the present invention, an LED module substrate connector for holding, and establishing electrical connection of, an LED module substrate includes: a lower cover member for placing the LED module substrate thereon; and an upper cover member pivotally attached to an end of the lower cover member. The upper cover member includes a feeding connection terminal configured to be elastically in contact with a feeding pad provided in the LED module substrate. When the upper cover member is closed relative to the lower cover member with a pivotal movement, the connection terminal elastically connects with a surface of the feeding pad while sliding thereon.

Here, the structure for pivotally attaching the upper cover member to the lower cover member is not limited to any particular structure. For example, the upper and lower cover members may be mutually hinged at ends thereof via a hinge structure.

Such a hinge structure is also not limited to any particular coupling structure. Axial attachment or pivotal attachment, for example, may be employed.

According to the aspect of the present invention, the LED module substrate is placed on the lower cover member and the upper cover member is then closed relative to the lower cover member with a pivotal movement. This allows the LED module substrate to be held by the upper and lower cover members.

With this configuration, the feeding connection terminal provided in the upper cover member elastically comes in contact with the surface of the feeding pad in the LED module substrate while sliding thereon along with the pivotal movement of the upper cover member. Thus, a self-cleaning action is exerted on the contact part.

At this time, if the connection terminal extends in a direction not perpendicular to a pivotal movement direction of the upper cover member and if a contact part of the connection terminal elastically connects with the surface of the feeding pad while sliding thereon in two directions, i.e., an elastic displacement direction of the connection terminal and the pivotal movement direction of the upper cover member when the upper cover member pivots in a closing direction, a further enhanced self-cleaning action is exerted on the contact part.

Here, the phrase "the connection terminal extends in a direction not perpendicular to a pivotal movement direction of the upper cover member" means that if an elastic piece, having a free end with a tip serving as a contact part, extends from a contact provided in the upper cover member for connecting with an external power supply, for example, the extending direction is not perpendicular to the pivot axis direction of the upper cover member.

According to the connector of the aspect of the present invention, the upper cover member is pivotally attached to the lower cover member beforehand. This allows the upper and lower cover members to be handled together and prevents the connection terminal provided inside the upper cover member from being unintentionally touched and thereby being deformed.

Moreover, along with the pivotal movement of the upper cover member, the connection terminal in the upper cover member connects with the feeding pad in the LED module substrate while sliding thereon. This causes the self-cleaning action and thereby achieves highly-reliable electrical connection.

BRIEF DESCRIPTION OF DRAWINGS

FIG. 1A shows a state in which an upper cover member is opened. FIG. 1B shows a state in which the upper cover member is closed as a transparent view of the upper cover member. FIGS. 1C and 1D show movements of connection terminals in contact with feeding pads. FIG. 1E is a side transparent view illustrating a state in which the upper cover member is closed.

FIG. 3A is a side view thereof. FIG. 3B is a plan view thereof. FIG. 3C is a side view as seen in a pivot axis direction. FIGS. 3D and 3E show movements of the connection terminals.

DESCRIPTION OF EMBODIMENTS

While a configuration example of a connector of an embodiment of the present invention will be described below with reference to the drawings, the present invention is not limited thereto.

In the connector of an embodiment of the present invention, an upper cover member 10, which is pivotable via a hinge structure, is coupled to an end of a lower cover member 20 having an attachment part 21 for placing and attaching an LED module substrate 30 thereon as shown in FIGS. 1A to 1E and 2.

Figure 4:
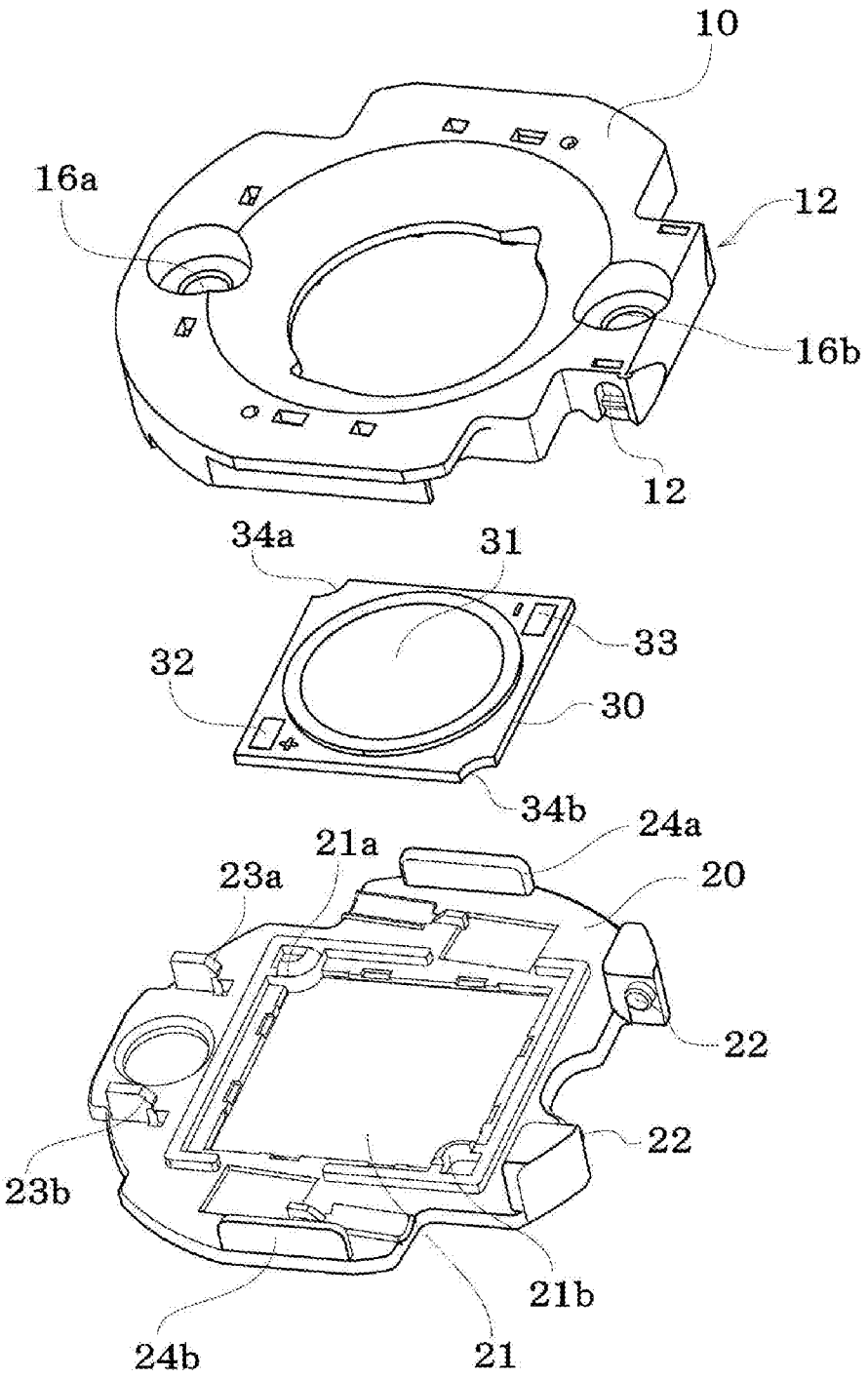
FIG. 4 shows an exploded view in a state in which the upper cover member and the lower cover member are separated from a pivotal attachment part.

The hinge structure is not limited to any particular hinge structure. In the present embodiment, however, a pair of pivotal attachment protrusions 22 are disposed, by way of example, so as to face each other at the end of the lower cover member 20, and a pair of pivotal attachment recesses 12 are provided at a corresponding end of the upper cover member 10 as shown in FIG. 4.

With this configuration, the upper cover member 10 can be pivotable with respect to the lower cover member 20 by fitting and pivotally attaching the pivotal attachment protrusions 22 in the lower cover member 20 into and to the pivotal attachment recesses 12 in the upper cover member 10.

Figure 1A:
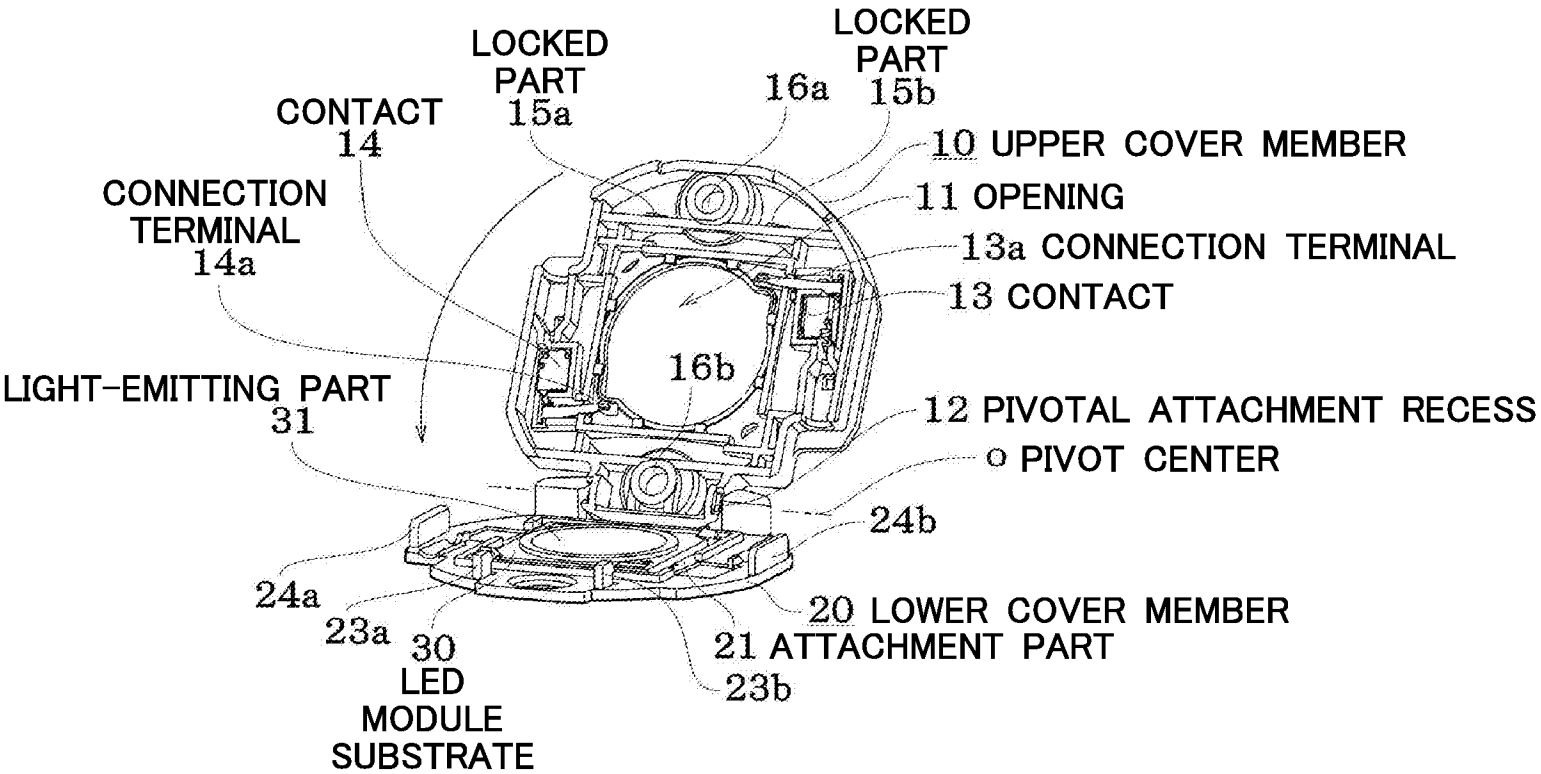
FIGS. 1A, 1B, 1C 1D, and 1E illustrate a configuration example of a connector for an LED module substrate according to an embodiment of the present invention.
Figure 1B:
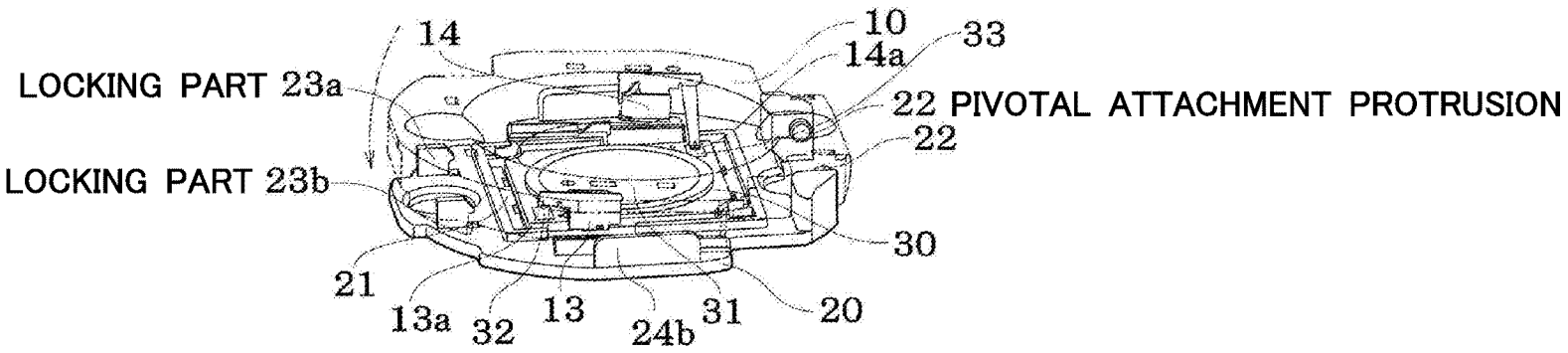
Figure 1C:
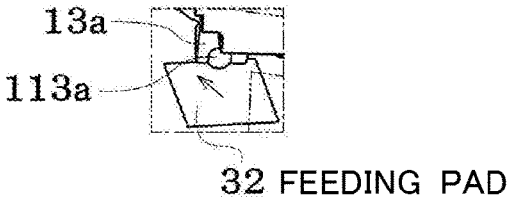
Figure 1D:
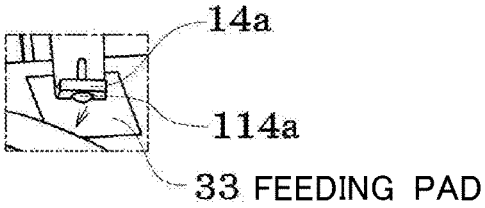
Figure 1E:
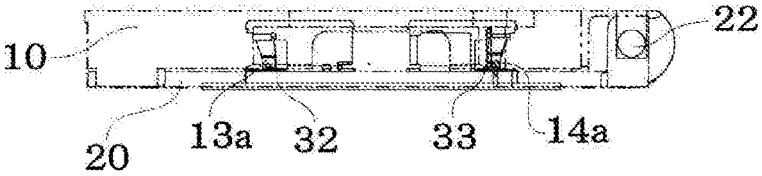

Such a pivotal attachment axis is illustrated in FIG. 1A as a pivot center O with an alternate long and short dash line.

The lower cover member 20 has the attachment part 21 for placing and attaching the LED module substrate 30 thereon. The LED module substrate 30 is attached in the attachment part 21.

The LED module substrate 30 includes: a light-emitting part 31 having a mounted LED element; and feeding pads 32 and 33 for providing power to the mounted LED element.

Positioning recesses 34*a* and 34*b* are provided at corner portions of the LED module substrate and positioning protrusions 21*a* and 21*b* are provided at corner portions of the attachment part 21 in the lower cover member 20, by way of example, so that the attachment positions can be easily found mutually when the LED module substrate 30 is attached to the lower cover member 20.

The upper cover member 10 includes: an opening 11 through which light emitted from the light-emitting part 31 of the LED module substrate 30 can be directed to the outside; and contacts 13 and 14 for connecting to an external power supply via a cable, for example.

In the present embodiment, the contacts 13 and 14 include: connection parts 13*b* and 14*b* into which cable cores are inserted for connection; and connection terminals 13*a* and 14*a* each made of an elastic piece in the shape of a plate spring having a free end on a tip side as seen from a main part of the contact, as shown in FIGS. 3A to 3E.

The connection terminals 13*a* and 14*a* are disposed with a predetermined angle (including a case parallel to the direction of the pivotal attachment axis) so that the extending direction of the free end from the base adjacent to the contact main part is not perpendicular to the direction of the pivot center axis (direction of the pivotal attachment axis).

Movements of contact parts when the connection terminals 13*a* and 14*a* elastically come into contact with the feeding pads 32 and 33 in the LED module substrate 30 by closing the upper cover member 10 are illustrated in FIGS. 1C and 3A to 3E.

The connection terminals 13*a* and 14*a*, each having the free end, extend as the elastic pieces from the contacts 13 and 14 attached to the upper cover member 10. Thus, in the present embodiment, the connection terminal 14*a*, positioned closer to the pivot center O, first starts to be elastically in contact with the feeding pad 33, and then the connection terminal 13*a*, positioned farther away from the pivot center O, starts to be elastically in contact with the feeding pad 32.

Contact parts 113*a* and 114*a* of the connection terminals 13*a* and 14*a* are applied with a sliding force in the elastic displacement direction along with the elastic deformation of the connection terminals and a sliding force displaced in the pivotal movement direction from the pivot center side toward the free end side of the upper cover member 10 due to the pivotal movement of the upper cover member 10 in its closing direction. As the result, the contact parts 113*a* and 114*a* slide in directions indicated by oblique arrows as the vector synthesis of the aforementioned sliding forces.

As described above, since the contact parts slide also in the pivotal movement direction other than the elastic displacement direction of the connection terminals 13*a* and 14*a*, the contact parts have an enhanced self-cleaning action.

Locking parts 23*a* and 23*b* provided in the lower cover member 20 are configured to engage with locked parts 15*a* and 15*b* provided in the upper cover member 10 when the LED module substrate 30 is held by the upper and lower cover members 10 and 20 beforehand and then the upper cover member 10 is closed so that a stable contact pressure can be ensured in the feeding pad part.

Figure 2:
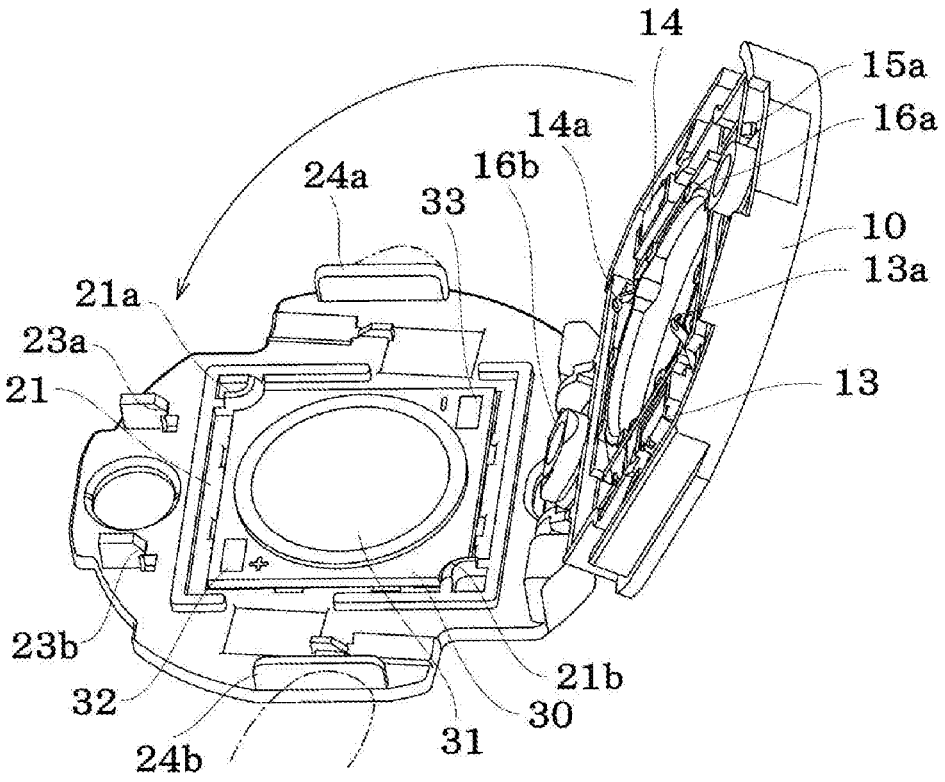
FIG. 2 is a perspective view illustrating a state in which the upper cover member is opened.
Figure 3A:
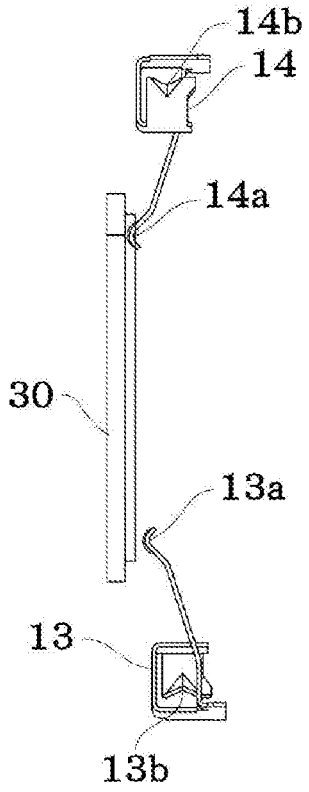
FIGS. 3A, 3B, 3C, 3D and 3E show a positional relationship between the connection terminals and the feeding pads when the upper cover member is closed toward a lower cover member.
Figure 3B:
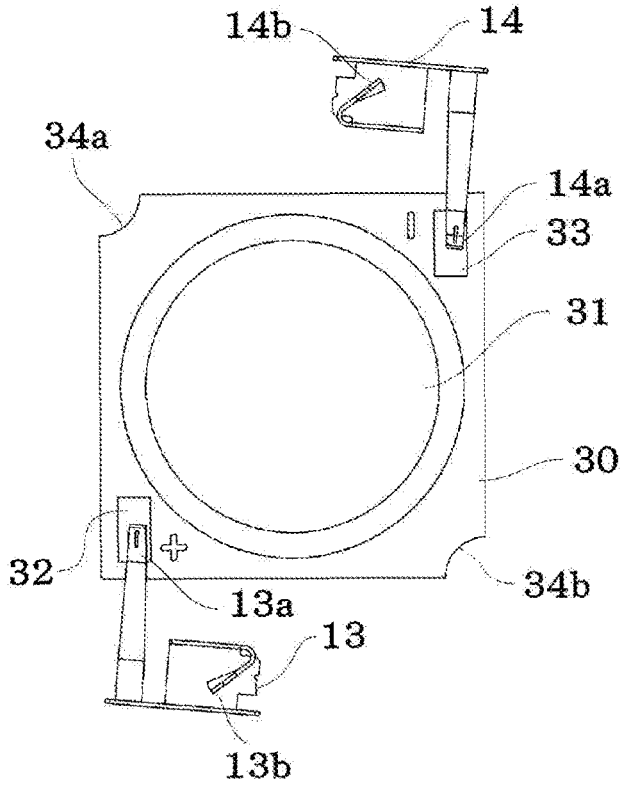
Figure 3C:
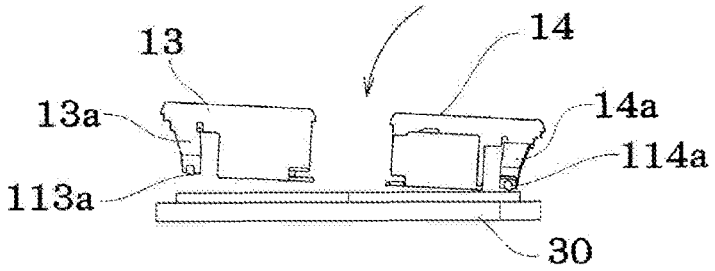
Figure 3D:
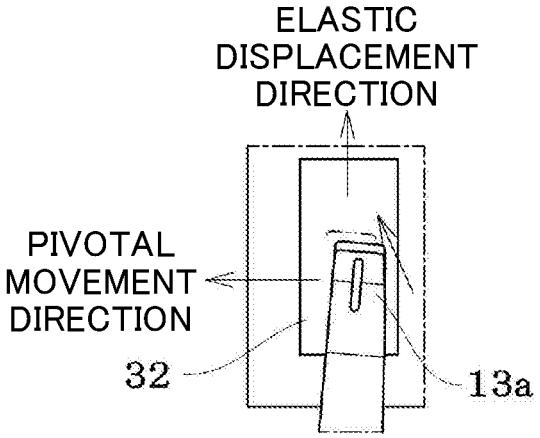
Figure 3E:
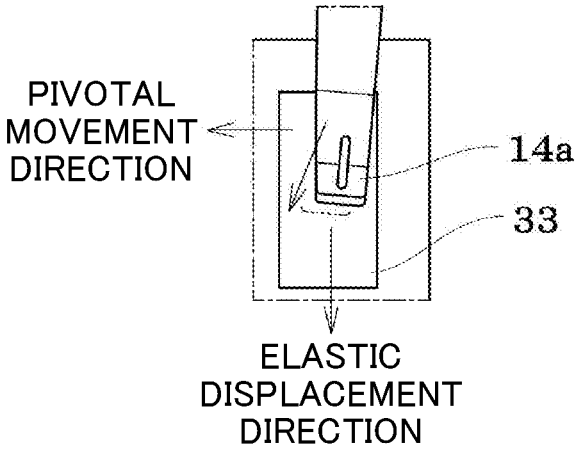

In order to facilitate opening and closing operations at such time, tabs 24*a* and 24*b* are vertically provided at both side portions of the lower cover member 20 as shown in FIG. 2. By doing so, the tabs 24*a* and 24*b* can be easily held with fingers.

Figure 5:
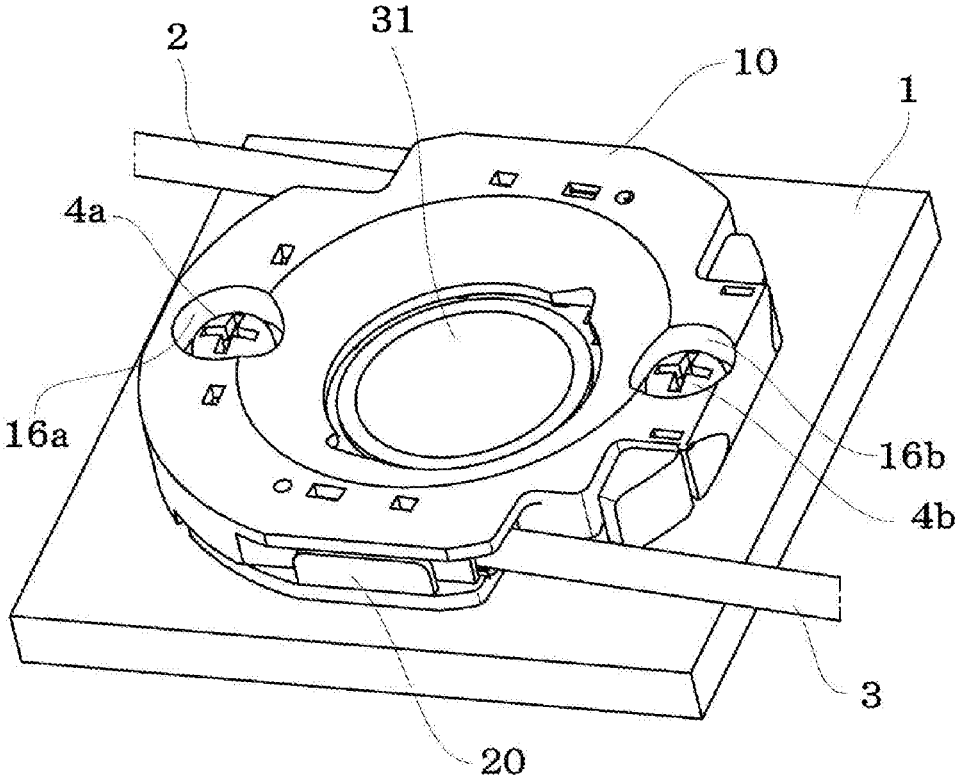
FIG. 5 shows a state in which the connector is fixed to a heat sink.

As shown in FIG. 5, the LED module substrate 30 set in the connector is fixed to a heat sink 1, for example, with fixtures 4*a* and 4*b* such as screws through attachment holes 16*a* and 16*b* provided in the upper cover member 10.

Next, the cores of cables 2 and 3 are connected to the connection parts 13*b* and 14*b* of the contacts 13 and 14 by insertion.

REFERENCE SIGNS LIST

10 upper cover member
11 opening
12 pivotal attachment recess
13 contact

13*a* connection terminal
14 contact
14*a* connection terminal
15*a* locked part
15*b* locked part
20 lower cover member
21 attachment part
22 pivotal attachment protrusion
23*a* locking part
23*b* locking part
30 LED module substrate
31 light-emitting part
32 feeding pad
33 feeding pad
O pivot center

The invention claimed is:

1. An LED module substrate connector for holding, and establishing electrical connection of, an LED module substrate, the connector comprising:

a lower cover member for placing the LED module substrate thereon; and an upper cover member pivotally attached to an end of the lower cover member, wherein the upper cover member includes a feeding connection terminal configured to be elastically in contact with a feeding pad provided in the LED module substrate, when the upper cover member is closed relative to the lower cover member with a pivotal movement, the connection terminal elastically connects with a surface of the feeding pad while sliding thereon, the connection terminal extends in a direction not radially perpendicular to a hinge axis of the upper cover member, and a contact part of the connection terminal elastically connects with the surface of the feeding pad while sliding thereon in both an elastic displacement direction of the connection terminal and also in a pivotal movement direction of the upper cover member different from the elastic displacement direction, when the upper cover member pivots in a closing direction.

2. The LED module substrate connector according to claim 1, wherein the connection terminal is in a shape of a plate spring having a free end on a tip side.

* * * * *